United States Patent [19]

Vifian

[11] 4,092,724

[45] May 30, 1978

[54] POLAR CONVERTER

[75] Inventor: Hugo Vifian, Santa Rosa, Calif.

[73] Assignee: Hewlett-Packard Company, Palo Alto, Calif.

[21] Appl. No.: 740,689

[22] Filed: Nov. 5, 1976

[51] Int. Cl.[2] ..... G06G 7/16; G06G 7/22; G06G 7/24

[52] U.S. Cl. ..... 364/817; 328/145; 364/850; 364/857

[58] Field of Search ..... 235/186, 189, 150.26, 235/150.27, 197, 196; 328/145, 160; 307/229; 324/132

[56] References Cited

U.S. PATENT DOCUMENTS

| | | | |
|---|---|---|---|
| 3,532,868 | 10/1970 | Embley | 328/145 X |
| 3,720,946 | 3/1973 | Chow et al. | 328/145 X |
| 3,740,750 | 6/1973 | Moulton | 328/145 X |
| 3,792,246 | 2/1974 | Gilbreath et al. | 235/186 |
| 3,849,706 | 11/1974 | Johnson et al. | 328/145 X |

*Primary Examiner*—Joseph F. Ruggiero
*Attorney, Agent, or Firm*—David A. Boone

[57] ABSTRACT

A polar display representing the ratio of two input signals is provided by exponentiating the logarithmic ratio of two input signals. The DC voltage thus produced, which is proportional to the ratio between the two input signals is then multiplied by a constant amplitude AC signal derived from one of the input signals and thus converted to an AC signal which is phase coherent with that input signal. This AC signal is then split into its orthogonal components, using an AC signal derived from the other input signal, to generate the X and Y coordinate of the polar diagram.

2 Claims, 5 Drawing Figures

POLAR CONVERTER

BACKGROUND AND SUMMARY OF THE INVENTION

Various graphical techniques have been used to provide a visual representation of complex circuit characteristics such as the transfer of reflection characteristics. One of these is the Bode diagram such as is shown in FIG. 1A. A polar representation is frequently more meaningful when dealing with characteristics such as the reflection characteristic since it can be more easily interpreted on a Smith chart, such as that shown in FIG. 1B. Polar diagrams can be generated over a small dynamic range by splitting the signal into its in-phase and quadrature-phase components, typically by synchronous detection, and coupling each component to the appropriate deflection plates of a CRT display. A typical circuit for this is shown in FIG. 2. This prior art method is fairly limited in that it is capable of handling only "single ended" signals over a fairly low dynamic range, e.g. 20dB, that is, the type of circuit cannot be used for ratio measurements.

In accordance with the preferred embodiment of the present invention, logarithmic convertors produce logarithmic output signals in response to two input signals. The difference between these two logarithmic signals is then obtained. This difference signal represents the log of the ratio of the two input signals. The difference signal is then input to an exponentiator. This expanded signal is then mixed with signals carrying phase information from the two input signals and is split into its orthogonal components to provide the control signals for the polar display. Thus, a polar display of the ratio of the magnitude and phase characteristics of two input signals is provided.

DESCRIPTION OF THE PREFERRED EMBODIMENT

Figure 1A:
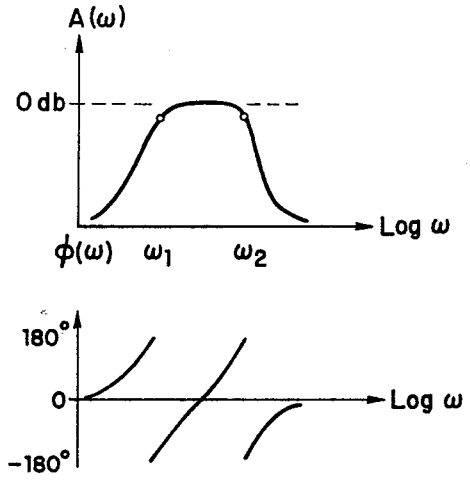
FIG. 1A shows a graphical representation of a circuit characteristic in accordance with a "Bode" diagram.
Figure 1B:
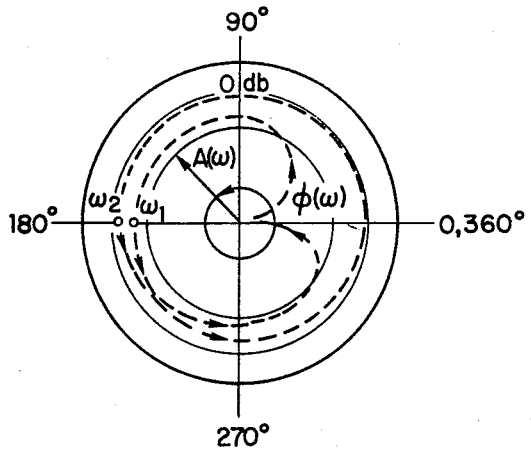
FIG. 1B shows a polar representation using a Smith chart.
Figure 2:
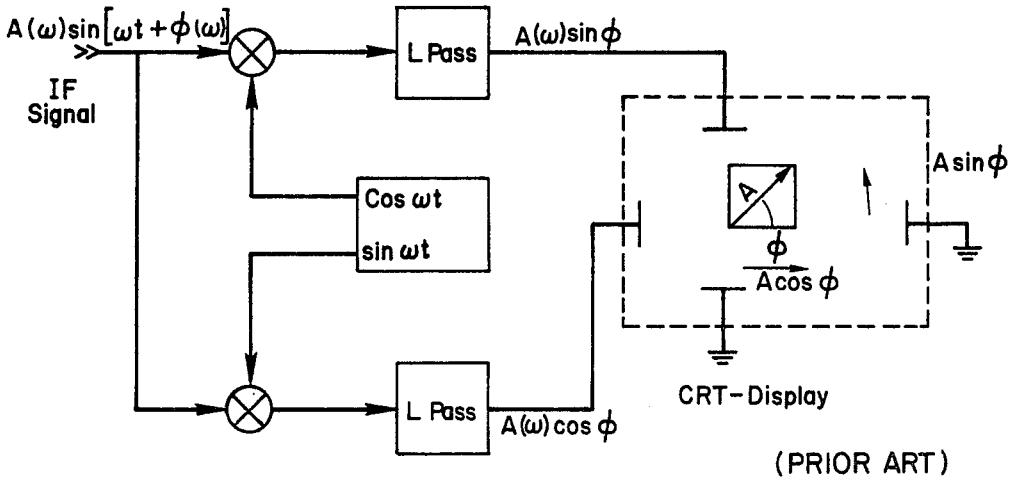
FIG. 2 is the block diagram of a typical prior art convertor.
Figure 3:
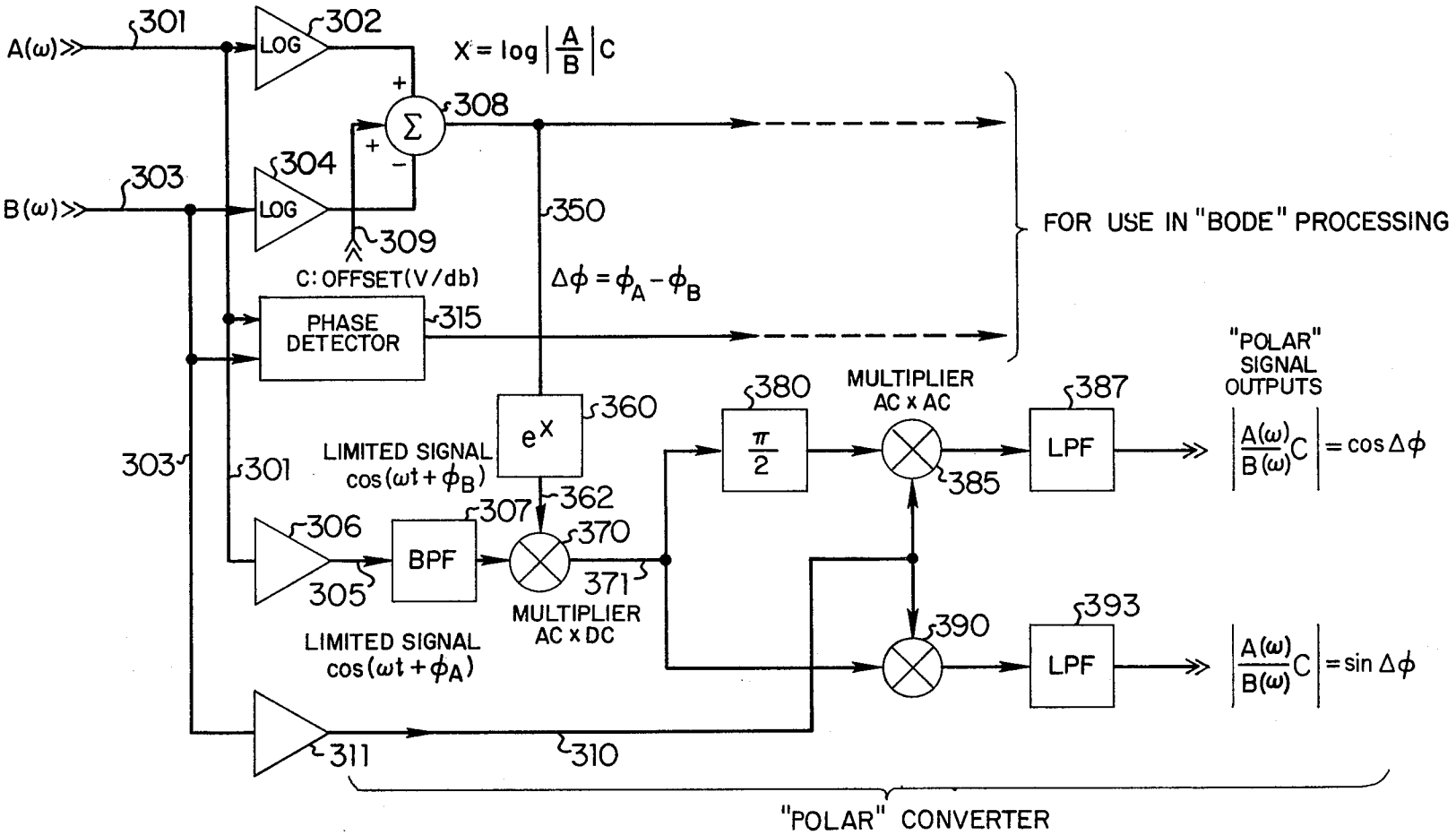
FIG. 3 is a block diagram of the preferred embodiment.

Referring now to FIG. 3, there is shown a block diagram of the preferred embodiment of the present invention. Two input signals A (W) on a line 301, and B (W) on a line 303, are input to a logarithmic convertor 302 and a logarithmic convertor 304, respectively. The output from logarithmic convertors 302 and 304 is input to difference circuit 308 which produces an output signal which represents the log of the ratio of the two input signals. That is, the signal output from difference circuit 308 equals $\log_e|(A/B)|C$. This signal output from difference circuit 308 onto line 350 is input to an exponentiator 360. Exponentiator 360, which is actually an inverse logarithmetric amplifier expands the signal on line 350 and provides a signal on line 362 which represents the ratio of the magnitude of the two input signals, A (W) and B (W).

However, for a complete display, phase information must also be supplied. To accomplish this, the signals on line 301 and 303 are input to amplifiers 306 and 311 respectively. Amplifiers 306 and 311 "clip," i.e., limit, these signals and produce the signals on lines 305 and 310. In this way, signals on lines 305 and 310 carry the phase information of the signals on 301 and 303, but do so at a constant magnitude level, i.e., magnitude variations in signals 301 and 303 no longer affect the signals on lines 305 and 310. These signals which contain the phase information of the signals on lines 301 and 303 are used to switch mixers 370, 385 and 390. The signal on line 310 is used to switch mixers or multipliers 385 and 390. The signal on line 310 is used as a reference, i.e., as a fixed phase signal. The signal on line 305 is passed through band pass filter 307 to mixer 370. Here, the DC signal output by exponentiator 360 is multiplied by the AC signal output from band pass filter 307. Therefore, a signal on line 371 is produced which has the magnitude of the ratio of the input signals on lines 301 and 303 but which has the phase information of the signal on line 301. The signal on line 310 has the phase information of the signal on line 303 but has been arbitrarily limited to a magnitude of one. However, it contains the important phase information of the signal on line 303.

Proceeding now with the generation of control signals for a polar display, the signal on line 371 is passed through 90° phase shifter 380 and input to mixer 85. The signal on line 371 is also input directly to mixer 390. The signal on line 310 is then input to both mixer 385 and mixer 390 to cause an AC × AC multiplication of the two signals. The outputs of mixer 385 and 390 are input to low pass filters 387 and 393 respectively. The outputs are then coupled to the X and Y inputs of any suitable display apparatus. A polar display is, therefore, provided which has the magnitude of the ratio of the magnitudes of the two input signals, and which has phase information equal to the phase difference between the two input signals.

Figure 4:
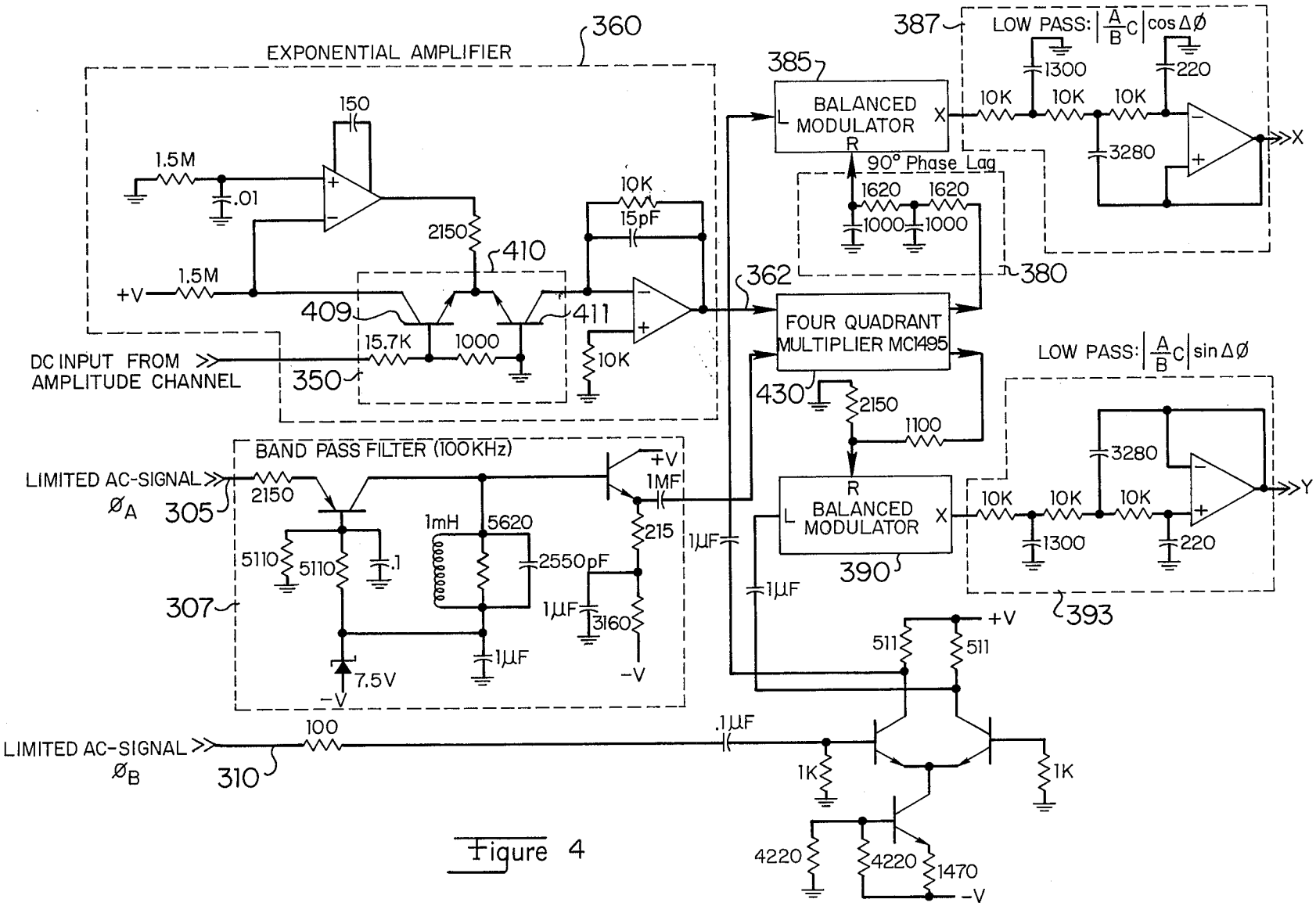
FIG. 4 is a detailed schematic diagram of a circuitry to implement a portion of the block diagram shown in FIG. 3.

Referring now to FIG. 4, there is shown a detailed schematic diagram of a portion of the circuitry shown in the block diagram of FIG. 3.

The exponential expanding of the signal on line 350 is accomplished by a transistor pair 410. Transistor 411, connected as a common base amplifier, is operated in the non-linear region of its transfer characteristic to provide linear signal on line 362. Four quadrant multiplier 430 is used to provide the functions of multiplier 370 and is similar to the MC1495, or the like, which is manufactured by Motorola and others.

I claim:

1. Apparatus for providing a polar display of the ratio of first and second electrical signals, said apparatus comprising:

logarithmic converter means for providing first and second logarithmic signals having a logarithmic relationship to said first and second electrical signals;

summing means coupled to said logarithmic converter means for providing a third electrical signal representing the difference between said first and second logarithmic signals;

first circuit means coupled to said summing means for providing a linear output signal in response to said third output signal;

limiting means for providing first and second limited signals representing the phase information of said first and second electrical signals, respectively;

first multiplier means coupled to said first circuit means and said limiting means for mixing the linear output signal with the first limited signal and for producing a first AC signal in response thereto; and output means coupled to said first multiplier means and said limiting means for providing polar display signals in response to said first AC signal and said second limited signal.

2. The apparatus as in claim 1 wherein said output means comprises;

phase shifting means coupled to said first multiplier means for providing a fifth electrical signal corresponding to said first AC signal and having approximately a ninety degree phase shift with respect thereto;

second multiplier means coupled to said phase shifting means and said limiting means for producing a first polar display signal in response to the fifth electrical signal and the second limited signal; and third multiplier means for providing a second polar display in response to said first AC signal and said second limited signal.

* * * * *